US006338482B1

(12) United States Patent
Geske et al.

(10) Patent No.: US 6,338,482 B1
(45) Date of Patent: Jan. 15, 2002

(54) APPARATUS FOR CONVERTING A FILE OF SUCCESSIVE SHEETS INTO A STREAM OF PARTIALLY OVERLAPPING SHEETS

(75) Inventors: Matthias Geske, Hamburg; Bernd Höpner, Halstenbek, both of (DE)

(73) Assignee: E.C.H. Will GmbH, Hamburg (DE)

( * ) Notice: Subject to any disclaimer, the term of this patent is extended or adjusted under 35 U.S.C. 154(b) by 0 days.

(21) Appl. No.: 09/434,301

(22) Filed: Nov. 5, 1999

(30) Foreign Application Priority Data

Nov. 5, 1998 (DE) ..... 198 50 901

(51) Int. Cl.[7] ..... B65H 29/66
(52) U.S. Cl. ..... 271/202; 271/183
(58) Field of Search ..... 271/151, 182, 271/183, 202, 216, 195

(56) References Cited

U.S. PATENT DOCUMENTS

| | | | | |
|---|---|---|---|---|
| 3,232,605 A | * | 2/1966 | Plummer et al. | 271/183 |
| 3,315,956 A | * | 4/1967 | Lyman | 271/202 |
| 3,380,734 A | | 4/1968 | Laumer | |
| 3,975,012 A | * | 8/1976 | Mathews | 271/183 |
| 4,221,377 A | | 9/1980 | Bodewein et al. | |
| 4,285,513 A | * | 8/1981 | Kwasnitza | 271/202 |
| 4,436,302 A | * | 3/1984 | Frye et al. | 271/202 |
| 4,776,577 A | | 10/1988 | Marschke et al. | |
| 5,221,079 A | * | 6/1993 | Most et al. | 271/202 |
| 5,251,891 A | | 10/1993 | Blaser et al. | |
| 5,265,862 A | * | 11/1993 | Jones et al. | 271/202 |
| 5,445,372 A | * | 8/1995 | Blaset et al. | 271/204 |

FOREIGN PATENT DOCUMENTS

| | | |
|---|---|---|
| DE | 26 01 081 | 7/1977 |
| DE | 34 13 179 A1 | 10/1985 |
| DE | 42 20 582 A1 | 2/1993 |
| DE | 43 07 383 | 9/1994 |
| DE | 196 16 714 A1 | 11/1997 |
| EP | 0 869 094 | 10/1998 |

* cited by examiner

*Primary Examiner*—H. Grant Skaggs
(74) *Attorney, Agent, or Firm*—Venable; Robert Kinberg

(57) ABSTRACT

A file of successive sheets is delivered to a converting station by a faster first conveyor, and a stream of partially overlapping sheets is removed by a slower second conveyor. Partial overlapping between the leading sections of successive sheets in the file and the trailing sections of the respective preceding sheets in the stream is due to the difference between the speeds of the two conveyors. A deflector assembly at the converting station ensures that the leading sections of successive sheets of the file can predictably overlap with the trailing sections of the immediately preceding sections of the stream by causing the trailing sections to move out of the way of oncoming leading sections and/or vice versa. To this end, the deflector assembly applies to the trailing sections and/or to the leading sections a force which can be varied in dependency upon one or more parameters such as the speed of the first and/or second conveyor; the flexibility, specific weight, moisture content and/or size of the sheets; the temperature at the converting station and/or in the path of the file; the dimensions of the leading and/or trailing sections of the sheets; and/or others.

33 Claims, 2 Drawing Sheets

APPARATUS FOR CONVERTING A FILE OF SUCCESSIVE SHEETS INTO A STREAM OF PARTIALLY OVERLAPPING SHEETS

CROSS-REFERENCE TO RELATED CASES

This application claims the priority of German patent application Serial No. 198 50 901.4 filed Nov. 5, 1998. The disclosure of the German patent application, as well as that of each US and foreign patent and patent application mentioned in the specification of the present application, is incorporated herein by reference.

BACKGROUND OF THE INVENTION

The present invention relates to improvements in apparatus for transporting and otherwise treating sheets of paper or the like. More particularly, the invention relates to improvements in methods of and in apparatus for converting a file of successive non-overlapping sheets into a stream of sheets wherein the leading portion or section of each next-following sheet overlaps with the trailing portion of the immediately preceding sheet.

Apparatus of the above outlined character can be uti- lized with advantage in paper processing plants wherein large panels are severed lengthwise and/or crosswise to yield sheets of a desired size and shape, and wherein the sheets are thereupon stacked into accumulations (e.g., those known as reams) which contain predetermined numbers of fully overlapping sheets. The thus obtained accumulations are thereupon wrapped and crated or boxed prior to shipment into storage or to the purchasers.

In order to properly stack successive sheets of a file of rapidly advancing sheets, it is necessary to re- duce the speed of successive oncoming sheets in a selected portion of the path for the file so that the trailing section of the braked sheet can be caused to predictably overlap with the leading section of the immediately following sheet. This is accomplished by diverting the trailing section of the braked sheet from the path of the leading section of the immediately following sheet (i.e., of the sheet which is about to be braked) and/or vice versa. As a rule, the trailing section of the freshly braked sheet is flexed downwardly so that the leading section of the next-following sheet can slide over and thus overlie the downwardly flexed trailing section of the immediately preceding sheet. The thus obtained stream of partially overlapping sheets is transported lengthwise to a stacking station where the sheets are gathered into reams or other suitable accumulations or piles.

An apparatus of the just described character is disclosed in German patent No. 26 01 081 A1. The patented apparatus employs a first endless belt conveyor for advancement of successive sheets of the file to a converting station where the oncoming sheets are braked to be properly overlapped by the leading sections of the next-following sheets, a second endless belt conveyor which transports the stream of partially overlapping sheets from the converting station, and a third conveyor which overlies portions of the first and second conveyors at the converting station to thus establish predictable paths for advancement of non-overlapping sheets to and for advancement of partially overlapping sheets from such station. The patented apparatus further comprises a suction-operated deflecting device which causes the trailing sections of successive sheets at the converting station to flex downwardly and to thus provide room for unimpeded advancement of the leading section of the next-following sheet over the thus flexed trailing section. The flow of air which is generated by the suction-operated deflecting device can further serve to flex the leading sections of successive oncoming sheets of the file upwardly and to thus further reduce the likelihood of collision between the trailing sections of preceding sheets and the leading sections of the immediately following sheets.

A drawback of the just described patented apparatus is that its operation is reliable, predictable and econo- mical under certain circumstances, and that such apparatus cannot automatically and/or reliably alter its mode of operation when an alteration is desirable, required or absolutely necessary. This can entail the turning out of large numbers of rejects and can affect the output or outputs of one or more machines which receives or receive partially overlapping sheets from the patented apparatus and/or which supply sheets to such apparatus.

OBJECTS OF THE INVENTION

An object of the invention is to provide an apparatus which can convert a file of successive sheets into a stream of partially overlapping sheets with a degree of reliability which is higher than that of heretofore known apparatus.

Another object of the invention is to provide an apparatus of the above outlined character which is more versatile than conventional apparatus.

A further object of the invention is to provide a novel and improved method of ensuring that the above out-lined apparatus can operate in a predictable and optimum manner under circumstances which are likely to change for any one of a host of different related and/or unrelated reasons.

An additional object of the invention is to provide the above outlined apparatus with novel and improved means for controlling the treatment of trailing sections of preceding sheets and/or of leading sections of next-following sheets at the station where such sheets are caused to partially overlap with each other.

Still another object of the invention is to provide an apparatus the operation of which is more economical than that of presently known and utilized apparatus because it turns out fewer rejects than such presently known apparatus.

A further object of the invention is to provide an apparatus which can be utilized as a superior substitute for presently used apparatus serving to convert a file of successive sheets into a stream of partially overlapping sheets.

Another object of the invention is to provide an apparatus which can carry out necessary adjustments in response to departures of the characteristics of sheets from anticipated characteristics and/or in response to changes in the mode of operation of the sheet advancing, braking and/or flexing means.

An additional object of the invention is to provide the above outlined apparatus with novel and improved means for reliably maintaining non-overlapping as well as partially overlapping sheets in their respective paths toward and away from the converting station.

Still another object of the invention is to provide the improved apparatus with novel and improved means for regulating the force which is being applied at the converting station in order to avoid collision between the trailing sections of successive last sheets of the stream and the leading sections of successive foremost sheets of the file of non-overlapping sheets.

A further object of the invention is to provide a production line which employs one or more apparatus of the above outlined character and the mode of operation of which can influence the operation of the apparatus in a sense to reduce the number of rejects (such as stacks containing improperly stacked sheets) and/or to increase the output.

SUMMARY OF THE INVENTION

One feature of the present invention resides in the provision of an apparatus for delivering successive flexible sheets of a file of non-overlapping sheets in a pre-determined direction along a first path wherein a trailing portion or section of each preceding sheet is located ahead of a leading portion or section of the next-following sheet to a file-converting station (also known as scalloping station) where the trailing sections of successive preceding sheets of the file are caused to overlap with the leading sections of the respective next-following sheets. The improved apparatus comprises means for supplying successive sheets of the file in the predetermined direction along the first path to the converting station at a first speed, means for removing successive sheets of the file from the converting station along a second path at a different second speed which is less than the first speed so that the leading sections of the sheets arriving at the converting station overlap with the trailing sections of the respective preceding sheets, means for deflecting at the converting station—with a variable force—at least one of each pair of sections including the trailing section of a preceding sheet and the leading section of the respective next-following sheet so that the sections of such pairs of sections can overlap each other, as a result of the difference between the first and second speeds, and means for varying the aforementioned variable force as a function of at least one of a plurality of variable parameters. Such variable parameters can include the aforementioned first and second speeds, the flexibility of sheets, the temperature in the first path and/or at the converting station, the moisture content of the sheets, the specific weight of the sheets, the dimensions of the leading and/or trailing sections of the sheets, and the orientation of the first and second paths relative to each other.

At least some of the sheets can include or constitute paper sheets.

The deflecting means can include means for directing the variable force at a right angle or at an oblique angle to the direction of movement of sheets along at least one of the first and second paths, or even in parallelism with the first or second path.

It is often preferred to provide the deflecting means with means for directing the aforementioned force against the trailing sections of the pairs of sections so that the thus deflected trailing sections of successive sheets are moved away from the path of the respective (immediately following) leading sections.

If each of the sheets comprises two or more thinner sheets or leaves, one of the aforementioned parameters can include the number of leaves in a sheet One of the parameters can include the thickness of the sheets.

The means for varying the aforementioned force can include means for varying the magnitude of such force (e.g., as contrasted with varying the direction of the force or the duration of application of the force).

For example, the means for varying the force can include at least one memory for storage of information pertaining to at least one of the variable parameters; for example, the information which is stored in the at least one memory can include characteristic curves and/or functions. The stored characteristic curves can have gradually and/or abruptly changing portions.

The variable force can be selected in such a way that it includes an upper and/or a lower threshold value.

If the at least one parameter is one of the first and second speeds, the force can vary at least substantially proportionally with variations of the one speed; the force can increase in response to an increase of the one speed and decrease in response to a reduction of the one speed. The variable force can decrease to zero when the one speed decreases to a predetermined minimum value, and such force can remain constant at a predetermined maximum value when the one speed reaches or rises above a preselected speed.

The deflecting means can comprise at least one suction generating device, e.g., a blower or an ejector. More specifically, the at least one suction generating device can comprise air stream generating means and means for directing the generated air stream against one side of the trailing section of each of the aforementioned pairs of sections to thus establish a low-pressure zone which causes or entails a deflection of the trailing section from the path of the oncoming leading section of the respective pair of sections. The air stream generating means is or can constitute a variable-output air stream generating means, and the means for varying the force can include means for varying the output of the air stream generating means.

The air stream generating means can be spaced apart from the directing means, and the suction generating device can further comprise a conduit which connects the air stream generating means with the directing means; the force varying means can comprise an adjustable valve in the conduit and means for adjusting the valve as a function of the at least one parameter to thus alter the rate of air flow from the suction generating device to the directing means. The valve adjusting means can comprise a prime mover which is adjustable in dependency upon variations of the at least one parameter.

The air stream generating means can comprise an air compressor, and the at least one suction generating device of such apparatus can further comprise means for limiting the pressure of air which is being supplied by the air compressor.

The apparatus can further comprise a conveyor (e.g., an endless belt conveyor) which cooperates with at least one of the aforementioned sheet supplying and sheet removing means to define the respective path. Such apparatus can further comprise means for adjusting the conveyor relative to at least one of the sheet supplying and sheet removing means. The adjusting means can be located at the converting station. If the conveyor comprises an endless flexible element, the adjusting means for such conveyor can comprise a roller which engages the endless flexible element and is movable relative to at least one of the sheet supplying and sheet removing means. One side of the flexible element can confront the deflecting means, the supplying means and the removing means, and the other side of such flexible element can be contacted by the adjusting means. The supplying means can comprise a first pulley at the converting station, the removing means can comprise a second pulley at the converting station, and the directing means can be disposed between the two pulleys and can confront the roller of the adjusting means for the conveyor.

Another feature of the invention resides in the provision of a method of delivering successive flexible sheets of a file of non-overlapping sheets in a predetermined direction along a first path wherein a trailing section of each preceding sheet is located ahead of a leading section of the next-following sheet to a scalloping or converting station where the trailing sections of preceding sheets are caused to overlap with the leading sections of the respective next-following sheets. The improved method comprises the steps of supplying successive sheets of the file in the predetermined direction along a first path to the converting station at a first speed, removing successive sheets of the file from the converting station along a second path at a different second speed less than the first speed so that the leading sections of sheets arriving at the converting station overlap with the trailing sections of the respective preceding sheets, deflecting at the converting station—with a variable force—at least one of each pair of neighboring sections including the trailing section of a preceding sheet and the leading section of the respective next-following sheet so that the sections of the pairs come to overlap with each other as a result of the difference between the first and second speeds, and varying the aforementioned force as a function of at least one of a plurality of variable parameters including the first and second speeds, the flexibility, moisture content and specific weight of sheets, the temperature at the first path and/or at the converting station, the dimensions of the leading and/or trailing sections of the sheets, and the orientation of the first and second paths relative to each other.

The novel features which are considered as characteristic of the invention are set forth in particular in the appended claims. The improved apparatus itself, however, bot as to its construction and the modes of assembling and operating the same, together with numerous additional important advantageous features and attributes thereof, will be best understood upon perusal of the following detailed description of certain presently preferred specific embodiments with reference to the accompanying drawings.

DESCRIPTION OF PREFERRED EMBODIMENTS

Figure 1:
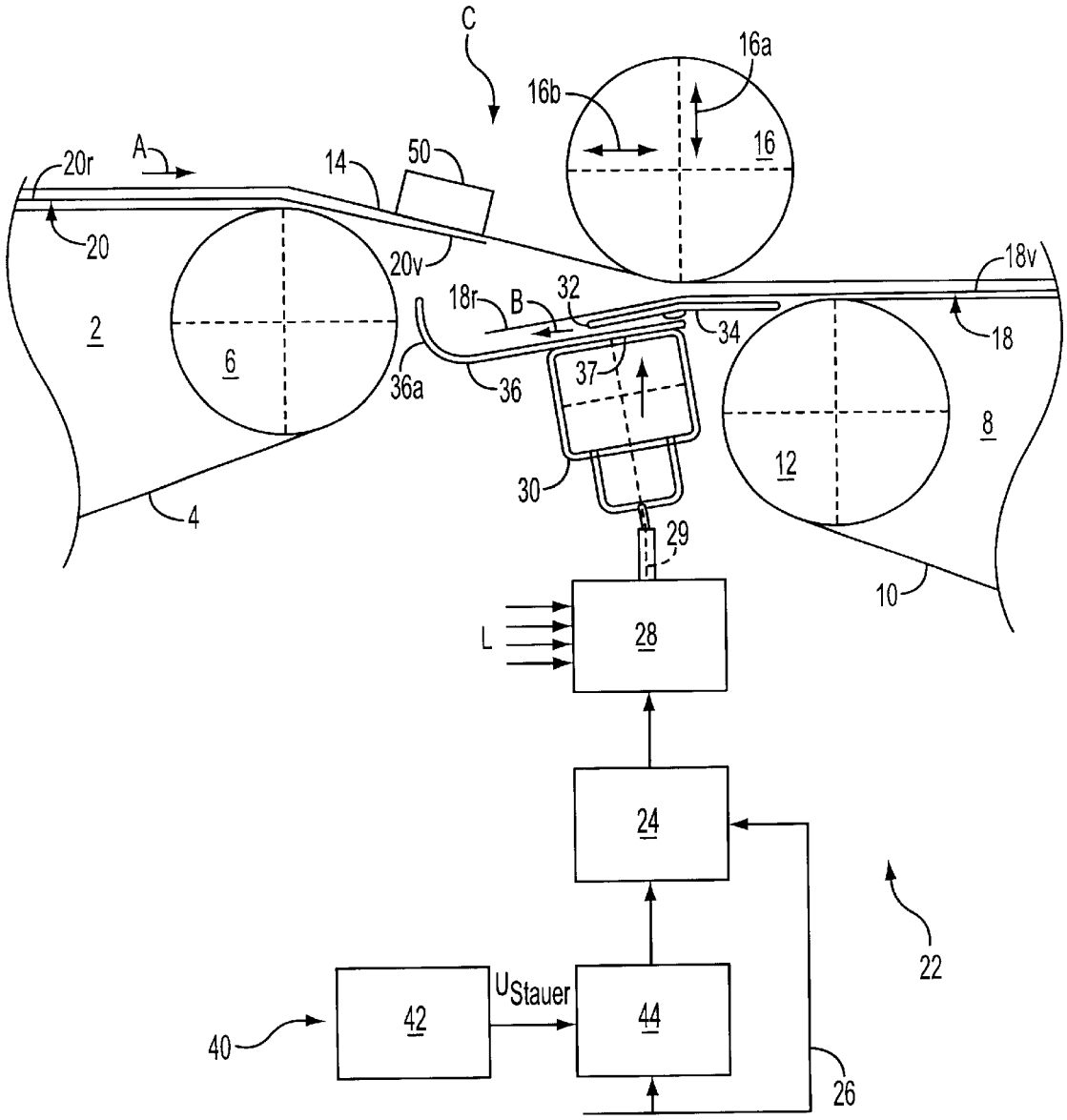
FIG. 1 is a fragmentary partly elevational, partly vertical sectional and partly diagrammatic view of an apparatus which embodies one presently preferred form of the invention.

The apparatus certain details of which are shown in FIG. 1 can be utilized with advantage in a paper processing machine wherein a wide paper web or large panels of paper issuing from a paper making machine is or are cut lengthwise and/or crosswise to yield one or more files of non-overlapping sheets ready to be converted into one or more streams of partly overlapping sheets. The sheets or such stream or streams can be treated or processed individually (e.g., in a printer) or converted into successive piles (e.g., reams or analogous accumulations) ready to be wrapped, boxed, baled or crated preparatory to shipment to storage and/or to purchasers.

It is equally possible to draw a continuous web of paper (or other material) off the core of a reel and to sever the web lengthwise (if the width of the web exceeds the desired widths of the sheets) and/or crosswise at regular intervals to thus obtain discrete sheets having a desired length.

The apparatus of FIG. 1 is designed to convert a single file or row of non-overlapping discrete paper sheets 20 into a single stream of partially overlapping sheets 18. Successive sheets 20 of the file are supplied by a first coveyor 2 in the direction indicated by an arrow A to a converting (also called scalloping) station C where the leading sections or portions 20*v* of successive sheets 20 are caused to overlap with the trailing sections or portions 18*r* of successive rearmost sheets 18 of the aforementioned stream of sheets. The trailing section or portion 20*r* of each sheet 20 approaching the station C is located immediately in front of or close to the leading section or portion 20*v* of the immediately following shet 20 of the file advancing toward the station C along a first path which is defined by one or more end-less flexible elements (e.g., bands or belts) 4 of the first conveyor 2 with the lower reach or stretch of an endless flexible element (e.g., belt) 14 of an adjustable (third) conveyor extending across and beyond the station C. The belt 14 cooperates with one or more endless belts or bands 10 of a second conveyor 8 which serves to transport successive sheets 18 of the stream of partially overlapping sheets 18 away from the station C on to a further station or location, e.g., to a machine which gathers predetermined numbers of sheets 18 into stacks of accurately and fully overlapping sheets.

The conveyor 2 supplies successive sheets from a severing station (not shown) wherein a continuous paper web is being severed by a suitable crosscutting tool to form a succession of discrete sheets 20. It is often advisable to operate the conveyor 2 at a speed at least slightly exceeding the speed of advancement of the continuous web toward the severing station; this ensures that the trailing section 20*r* of each freshly obtained sheet 20 moves at least slightly away from the leading section 20*v* of the next-following sheet 20 of the file advancing toward the converting station C. The speed of advancement of the web toward the severing station is known as the machine speed.

It is assumed that the conveyor 2 for the file of sheets 20 comprises several endless flexible belts 4 which are trained over several pulleys including the pulley 6 adjacent one side of the converting station C. The second conveyor 8 normally also comprises several endless belts 10 which are trained over several pulleys including the pulley 12 adjacent the other side of the station C. The endless belt or belts 14 of the third conveyor cooperate with the belts 4 to define a first path for advancement of sheets 20 toward the station C, and the belt or belts 14 also cooperate with the belts 10 to define a second path for advancement of sheets 18 toward the next-following (e.g., stacking) station, not shown. The belt or belts 14 of the third conveyor are also trained over at least two pulleys (not shown) at least one of which is driven to advance the lower reach or stretch of the illustrated belt 14 in the direction of the arrow A, preferably at the speed of the belts 4.

The width of the path for the sheets 20 and/or for the sheets 18 is adjustable by a roller 16 which is preferably adjustable in several directions (note the double-headed arrows 16*a* and 16*b*) and is located at the converting station C where a deflecting device 30 ensures that the trailing sections 18*r* of successive sheets 18 cannot interfere with unimpeded and predictable forward movements of the leading sections 20*v* of successive sheets 20. The arrows 16*a*, 16*b* show that the illustrated roller-shaped adjusting means 16 is movable substantially at right angles to as well as longitudinally of the lower reach of the illustrated endless flexible element 14 of the third conveyor. It is clear that the roller 16 can be made adjustable in one or more directions other than those indicated by the arrows 16*a* and 16*b*, e.g., in one or more additional directions. It is also possible to adjustably mount the roller 16 in such a way that it can be shifted in any desired direction which is required to ensure the establishment of satisfactory paths for the sheets 18 and/or 20. Still further, it is possible to replace the roller 16 with two or more rollers or with otherwise configurated adjusting means, e.g., with one or more shafts or rods, with one or more plate-like deflectors of sheet metal or the like or with a combination of two or more different combined adjusting and guide means.

The speed of the belts 4 forming part of the first conveyor 2 (and preferably also the speed of the belt or belts 14 of the third conveyor) exceeds the speed of the belts 10 forming part of the second conveyor 8. Thus, the pulley 6 (which is assumed to receive rotary motion from a variable-speed prime mover, not shown) drives the belts 14 at a speed v (see FIGS. 2*a* and 2*b*) exceeding the speed of the pulley 12. If the pulley 12 is the driving pulley of the second conveyor 8, it receives torque from a variable-speed prime mover or from a constant-speed prime mover (not shown) to advance the belts 10 at a speed less than that of the belts 4 and the belt or belts 14. The driver pulley for the third conveyor including the illustrated belt 14 can receive motion from the variable- speed prime mover for the pulley 6.

The difference between the speeds of the belts 4 and 10 determines the extent of overlap of the trailing sections 18*r* of successive sheets 18 with the leading sections 20*v* of successive oncoming sheets 20 of the file being delivered by the conveyor 2. The apparatus preferably further comprises a suitable braking device 50 which acts directly upon the oncoming sheets 20 to reduce their speed from that imparted by the conveyor 2 to the speed of the conveyor 8. The illustrated braking device 50 is assumed to act upon the sheets 20 at the station C between two or more neighboring belts 14 of the third conveyor. However, it is equally possible to install the braking device 50 (or several braking devices) at any other convenient location where the braking device or devices can effectively reduce the speed of oncoming sheets 20 in good time for the carrying out of a satisfactory overlapping operation between the trailing section 18*r* of a sheet 18 already advanced by the conveyor 8 and the leading section 20*v* of the oncoming sheet 20.

The establishment of satisfactory and predictable overlap between the trailing sections 18*r* of successive rearmost sheets 18 of the stream of sheets 18 in the path between the conveyor 8 and the belt or belts 14 and the leading sections 20*v* of successive foremost sheets 20 of the file of sheets 20 in the path defined by the conveyor 2 and the belt or belts 14 further necessitates the provision of means for deflecting, at the station C, successive leading sections 20*v* and/or successive trailing sections 18*r* to an extent which is required to ensure that each leading section 20*v* can move above and to overlie the immediately preceding trailing section 18*r*. The deflecting means generates a variable force (denoted by the arrow B) which, in the apparatus of FIG. 1, acts primarily upon the trailing sections 18r of successive sheets 18. In accordance with an important feature of the present invention, the improved apparatus further comprises means for varying the force B as a function of one or more variable parameters including the speed of the belts 4 and/or the speed of the belts 10, the flexibility of the sheets, the temperature in the first path between the belts 4 and the belt or belts 14, the temperature to which the sheets are subjected at the station C, the moisture content of the sheets, the specific weight of the sheets, the dimensions of the leading sections 18*v*, 20*v* and/or the trailing sections 18*r*, 20*r*, the orientation of the first path (for the sheets 20 of the file of sheets) relative to the second path (for the sheets 18 of the stream of sheets) and/or several others, all as will be described in full detail hereinafter.

The deflecting means which generates the variable force B is denoted by the character 30, and the character 22 denotes the means for varying the force B. The illustrated means 30 for deflecting at least the trailing sections 18*r* of the sheets 18 and the illustrated force varying means 22 constitute an integral unit including parts located at the converting station C between the pulleys 6, 12 at the underside of the illustrated belt 14 and opposite the adjusting roller 16 for the belt(s) 14. The force varying means comprises a booster 24 which receives compressed air by way of a conduit 26 and serves as a means for varying the output of an ejector 28. The ejector 28 draws (at L) atmospheric air in response to admission of compressed air from the booster 24 and its outlet admits a relatively large-volume air flow into a conduit 29 which, in turn, admits air into the deflecting means 30. The volume of the air flow being admitted into the conduit 29 can be several times that of the air flow supplied to the ejector 28 by the booster 24.

The deflecting means 30 comprises a housing which is disposed at the station C between the pulleys 6 and 12 and has an outlet 31 serving to discharge air in a direction toward the underside of the lower reach of the illustrated belt 14. The air stream flowing from the housing of the deflecting means 30 via outlet 31 is compelled to issue from the deflecting means by way of a slot 32, and such air stream generates the variable force B while flowing along the underside of the immediately adjacent sheet 18, and more specifically along the underside of the trailing section 18*r* of such sheet. The slot 32 is defined by two plate-like guides 34, 36 which are or which can be made of a metallic sheet material and are offset relative to each other as seen in the direction of air flow from the slot 32. The guide 34 is adjacent the pulley 12 of the conveyor 8 and at least partially overlies the outlet 31 of the housing of the deflecting means 30. The other guide 36 is adjacent the pulley 6 of the conveyor 2 and is carried by the housing of the deflecting means 30 adjacent the left-hand side of the outlet 31 as viewed in FIG. 1. The guide 36 comprises, or can comprise, an upwardly extending free end portion 36*a* which guides the outflowing air upwardly toward the underside of the leading section 20*v* of the sheet 20 advancing toward the position of overlap with the trailing section 18*r* of the somewhat slower rearmost sheet 18.

The operation of the deflecting means 30 is based on the so-called airfoil or aerofoil principle. Thus, the air flow issuing from the slot 32 is guided by the adjacent portions of the guides 34, 36 to flow counter to the direction indicated by the arrow A; this entails a drop of pressure in accordance with the Bernoulli equation and the drop of pressure at the underside of the trailing section 18*r* of the rearmost sheet 18 in the path between the belts 10, 14 causes the trailing section 18*r* to flex downwardly, i.e., toward the upper side of the guide 36 to the right of the free end portion 36*a*. The just described phenomenon entails an increase of the gap between the downwardly flexed trailing section 18*r* and the oncoming leading section 20*v* at the converting station C. The width of such gap between the sections 18*r* and 20*v* is further increased because the free end portion 36*a* causes the air to flow upwardly and to impinge upon the underside of the leading section 20*v* arriving at the station C. Such upwardly flowing air causes the upper side of the leading section 20*v* to bear against the underside of the illustrated lower reach of the belt 14. The latter guides the leading section 20*v* to gradually approach the immediately preceding downwardly flexed trailing section 18*r* while the sheet 20 moves forwardly relative to the adjacent sheet 18 so that the sections 18*r*, 20*v* overlie or overlap each other to a desired extent.

It has been found that the reliability of the improved apparatus depends to a considerable extent upon proper selection and retention of the distance between the underside of the belt 14 of the third conveyor and the slot 32 between the guides 34, 36 above the housing of deflecting means 30. It was further ascertained that the reliability of the apparatus is greatly affected by the selected angle or orientation of the belt 14 at the station C. The just mentioned distance and the just mentioned orientation can be selected, with a high degree of accuracy, by the adjusting roller 16 and/or by the aforediscussed adjusting means which is utilized in addition to or in lieu of the roller 16. Thus, by moving the adjusting roller 16 in at least one of the directions indicated by the double-headed arrows 16*a* and 16*b*, one can influence the configuration of the substantially triangular space between the underside of the belt 14 and the guides 34, 36. The roller 16 (or an equivalent adjusting means) can be adjusted by hand, by remote control or automatically.

The adjustable force B which is generated by the deflecting means 30 and acts upon the undersides of the trailing sections 18*r* of successive sheets 18 is a suction-induced force, and its magnitude is regulated or varied (when necessary) by the force varying means 22 including the aforementioned booster 24, ejector 28 and conduits 26, 29. The force varying means 22 further comprises a control arrangement 40 which, in the embodiment of FIG. 1, indirectly influences the extent of suction, i.e., the magnitude of the force B. To this end, the control arrangement 40 comprises an adjusting means 42 for an adjustable proportional valve 44. The illustrated adjusting means 42 is designed to transmit to the valve 44 electrical control signals $U_{steuer}$ which regulate the operation of the valve 44 and hence the flow of compressed air in the conduit 26. The valve 44 is designed to convert, at least substantially linearly, the electric signals $U_{steuer}$ into pneumatic signals which are utilized to regulate the operation of the booster 24 for the variable-output ejector 28.

The electric signals $U_{steuer}$ are dependent upon one or more variable parameters including one or more parameters of the machine which embodies or cooperates with the improved apparatus, the variable characteristics of the sheets 18 and 20 and/or the variable parameter(s) of the surrounding atmosphere. Certain presently prefer-red parameters include the number of paths for one or more files of sheets 20 and the corresponding number of sheets 18, the thicknesses of the sheets 18, 20, the speed v of the first conveyor 2, the speed of the second conveyor 12, the moisture content of atmospheric air (e.g., as measured at the converting station C), the length of the sheets 18, 20, the temperature in the path for the sheets 20, the temperature at the station C, the specific weight of the material of which the sheets are made (in gsm), the dimensions of the leading sections 18*v*, 20*v* and/or the trailing sections 18*r*, 20*a* and/or many others. The adjusting means 42 preferably comprises one or more memories for the storage of information in the form of characteristic curves and/or functions. Such stored information furnishes, in dependency upon one or more aforeenumerated and/or other parameters, values for the electric signals $U_{steuer}$.

Figure 2A:
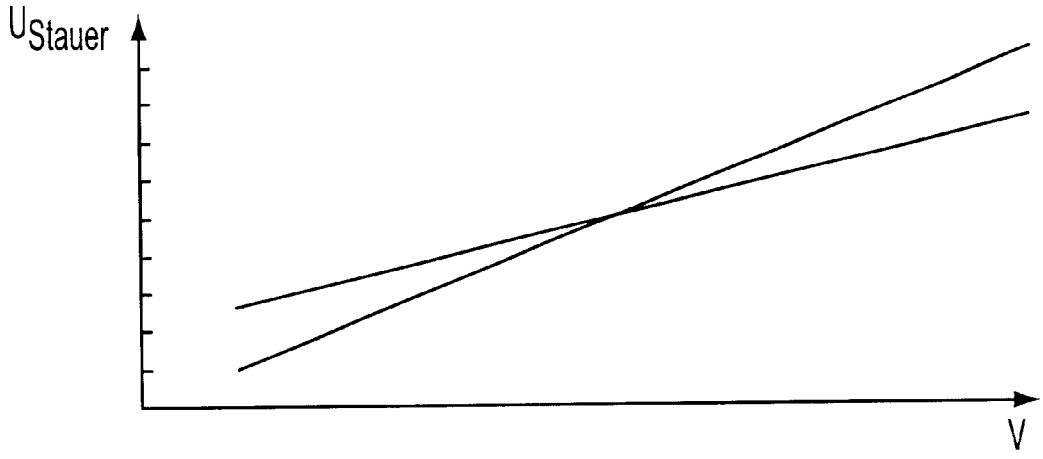
FIG. 2*a* shows a coordinate system wherein the curves denote one form of information which can be memorized and utilized to vary the force being applied at the converting station to avoid collision between the trailing sections of preceding sheets and the leading sections of the next-following sheets.

In the coordinate system of FIG. 2*a*, the speed v of the conveyor 2 or 8 (e.g., the conveyor 2) is measured along the abscissa and the intensities and/or other characteristics of the electric signals $U_{steuer}$ are measured along the ordinate. Two curves which are shown in FIGS. 2*a* are straight lines, i.e., the intensities of the signals $U_{steuer}$ vary proportionally with the speed v of the conveyor 2.

In lieu of selecting a variable parameter denoting the speed v of the conveyor 2, it is also possible to select the aforementioned machine speed, i.e., the speed of advancement of a continuous web toward the severing station where the web is cut at predetermined intervals to yield a succession of sheets 20 constituting the file being advanced by the belts 4 of the first conveyor 2. The ratio of the speed v of the conveyor 2 to the machine speed is constant.

When the magnitude of the variable force B varies in accordance with one of the linear characteristic curves shown in FIG. 2*a*, any increase in the speed v entails a corresponding increase of the intensity of electric signals $U_{steuer}$ and also a corresponding increase of suction at the undersides of the trailing sections 18*r* of the sheets 18 at the station C.

FIG. 2*a* further shows that the left-hand ends of the two linear curves do not extend all the way to the abscissa and/or to the ordinate. This is indicative of the fact that, when the speed v is relatively low, such as between zero speed and a rather low speed v, the adjusting means 42 does not transmit any signals $U_{control}$, i.e., the trailing sections 18*r* of successive sheets 18 are not acted upon by suction to be flexed downwardly and the leading sections 20*v* of the sheets 20 are not flexed upwardly against the underside of the belt 14.

It is to be noted that the straight curves in the coordinate system of FIG. 2*a* denote but one form of information which can be stored in the memory or memories of the adjusting means 42 to generate control signals $U_{control}$ which, in turn, regulate the adjustable valve 44 as a function of the selected parameter or parameters. For example, it is equally possible to store information in the form of characteristic curves exhibiting gradually as well as abruptly varying portions. Furthermore, each curve, or certain curves, can have an upper and/or a lower threshold value. Still further, the information which is stored in the memory or memories of the adjusting means can be in the form of arcuate (e.g., paranoidal) curves. One paranoidal curve is shown in the coordinate system of FIG. 2*b*.

Figure 2B:
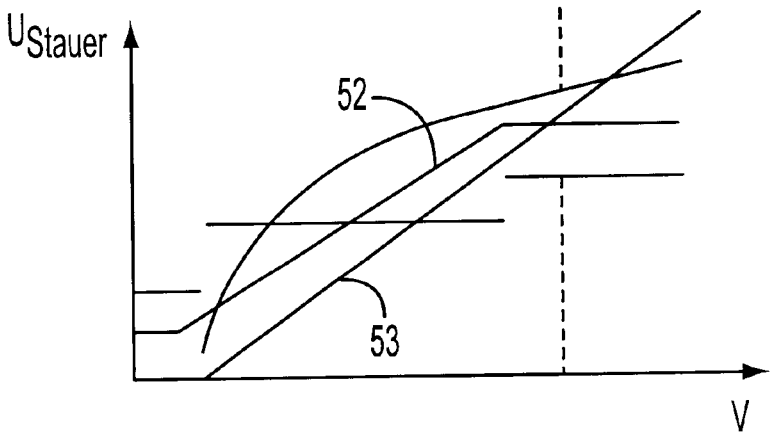
FIG. 2*b* shows a coordinate system wherein the curves represent different forms of information adapted to be utilized to regulate the magnitude of the aforementioned force.

The curve 52 shown in the coordinate system of FIG. 2*b* has a horizontal lower portion spaced from the abscissa, a gradually sloping intermediate portion, and a horizontal upper portion. When the value of $U_{control}$ varies in accordance with such curve, the variable force has a lower threshold value as well as an upper threshold value. Thus, the apparatus establishes a constant initial force B until the speed v of the conveyor 2 rises to a pre-selected value, and the apparatus establishes a constant maximum force when the speed v reaches or exceeds a prese- lected relatively high value.

It will be seen that the control arrangement 42 of the force varying means 22 indeed regulates the volumetric flow of air from the slot 32 as a function of one or more variable parameters denoting certain functions of the machine, certain characteristics of the sheets 18, 20 and/or certain characteristics of the surrounding atmosphere.

The ejector 28 can be replaced with a suitable blower, e.g., with a frequency-regulated blower having a rotor the RPM of which is regulated by the control arrangement 40 or an equivalent control arrangement to thus vary the volumetric rate of air flow from the housing of the deflecting means 30. It is also possible to replace the ejector 28 or the aforementioned blower with an adjustable slide valve which establishes a variable path for the flow of air to the housing of the deflecting means 30 as a function of the characteristics of signals being supplied by the adjusting means 42 or an equivalent thereof.

The improved apparatus preferably further comprises a suitable pressure limiting valve (e.g., in the conduit 26 and/or in the conduit 29, especially if the ejector 28 is replaced with a blower. The pressure limiting valve prevents an overstressing of the blower.

It will be readily appreciated that, depending on the nature of the parameters which are being resorted to for the generation of signals $U_{control}$, the control arrangement further comprises suitable sensors which are capable of ascertaining changes in the parameters of the machine, the characteristics of the sheets 18,20 and/or the temperature in the path for the sheets 20 and/or at the station C. Furthermore, the control arrangement can or must comprise suitable inputs for the transmission of various signals to the adjusting means 42. The exact construction of such auxiliary equipment, which can be of any known design, forms no part of the present invention.

Each of the sheets 18, 20 can comprise two or more superimposed leaves or layers of identical material or different materials. In such instances, one of the aforediscussed parameters can include the number of layers or plies in each sheet.

As already mentioned with reference to the coordinate system of FIG. 2*b*, the magnitude of the force B can amount to zero when the speed v of the conveyor 8 and/or 2 is relatively low; this does not affect the quality of treatment at the station C because the danger of collision between the trailing sections 18*r* and the oncoming leading sections 20*v* at a relatively low conveyor speed v is minimal. Analogously, when the speed v is relatively high and, therefore, the force B is rather large, any further increase of the speed v need not entail a further increase of magnitude of the force B because, under such circumstances, the force B suffices to reliably avoid collision between the trailing sections 18*r* and the on-coming leading sections 20*v*.

If the magnitude of the force B varies in accordance with the characteristic curve 53 in the coordinate system of FIG. 2*b*, i.e., if the magnitude of such force increases from zero when the speed v reaches a certain value above zero speed, the increase of speed v from zero speed to a preselected initial speed can be abrupt. The reason for this is that, when the sheets 18, 20 are rather stiff and the friction between the sheets and their advancing means is rather pronounced, any downward flexing of the trailing sections 18*r* and/or any upward flexing of the leading sections 20*v* can be effected only when the magnitude of the force B rises to a certain value which is a function of the sheet stiffness and/or friction.

The speed v of the first conveyor 2 preferably constitutes the sole variable parameter or one of the variable parameters when the speed of the conveyor 8 varies but the speed of the conveyor 2 is at least substantially constant. As already mentioned hereinbefore, the speed of the conveyor 2 is normally constant and such speed matches the machine speed or varies proportionally with the machine speed.

If the ejector 28 is replaced with a blower, the conduit 26 and/or 29 preferably contains a pressure relief valve on the ground that, if the blower is a frequency regulated blower, the speed of its rotor cannot be readily regulated down to zero speed.

If the ejector 28 and/or the blower is replaced by or used jointly with an adjustable slide valve, such valve can be regulated electrically or in any other suitable way, e.g., pneumatically.

An advantage of the illustrated apparatus which employs the ejector 28 is that the generation of noise is minimal as well as that the operation of the ejector can be regulated in a simple time- and space-saving manner such as by resorting to the adjustable proportional valve 44 in the conduit 26 or in any other suitable portion of the path for admission of compressed air to the ejector.

It is to be noted that the provision of the roller 16 and/or other suitable adjusting means for that portion of the third conveyor which cooperates with the first conveyor 2 and/or second conveyor 8 constitutes a feature which is believed to be novel and patentable per se, i.e., which can be resorted to in apparatus of the present invention and/or in analogous conventional apparatus regardless of the provision or absence of the aforementioned means for regulating the force B acting upon the leading sections 20*v* of the sheets 20 and/or upon the trailing sections 18*r* of the sheets 18. For example, it is believed to constitute a patentable invention to provide the apparatus with a third conveyor including the adjusting means 16 and/or analogous adjusting means and with a system which selects a force B that remains unchanged regardless of the nature of treated sheets, the circumstances at the station C and/or the mode of operation of the machine which employs the improved apparatus.

In addition to the advantages which are attributable to the provision of the roller and/or analogous adjusting means, the improved apparatus and method exhibit the advantage that, by regulating the magnitude of the force B in dependency on the aforediscussed (and possibly certain other) parameters, one can ensure that the extent to which the sections 18*r*, 20*v* are influenced at the station C can be varied in dependency upon variations of the operation of the machine (such as a paper making machine) which employs the apparatus, in dependency upon changes of one or more characteristics of the sheets and/or in dependency upon changes of circumstances prevailing at the station C and/or in the path of delivery of sheets 20 into the range of the variable force. This brings about substantial savings (as concerns the numbers of rejects) and increases the output of the machine. Moreover, the number of stoppages is reduced considerably and the number of attendants can be reduced due to the ability of the apparatus to automatically conform to and/or compensate for changes in the operating conditions.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the aforedescribed contribution to the art of making streams of partialy overlapping sheets and, therefore, such adaptations should and are intended to be comprehended within the meaning and range of equivalence of the appended claims.

What is claimed is:

1. Apparatus for delivering successive flexible sheets of a file of non-overlapping sheets in a predetermined direction along a first path wherein a trailing section of each preceding sheet is located ahead of a leading section of the next-following sheet to a scalloping station where the trailing sections of preceding sheets are caused to overlap with the leading sections of the respective next-following sheets, comprising:

means for supplying successive sheets of the file in said direction along said first path to said station at a first speed;

means for removing successive sheets of the file from said station along a second path at a different second speed less than said first speed so that the leading sections of sheets arriving at said station overlap with the trailing sections of the respective preceding sheets;

means for deflecting at said station, with a variable force, at least one of each pair of sections including the trailing section of a preceding sheet and the leading section of the respective next-following sheet so that the sections of said pairs can overlap with each other as a result of the difference between said first and second speeds; and means for varying said force including means for varying said force as a function of one of said speeds, wherein said variable force varies at least substantially proportionally with variations of said one speed, and wherein said variable force respectively increases and decreases in response to an increase and decrease of said one speed.

2. The apparatus of claim 1, wherein the sheets include paper sheets.

3. The apparatus of claim 1, wherein said deflecting means includes means for directing said variable force at an angle to the direction of movement of sheets along at least one of said paths.

4. The apparatus of claim 3, wherein said angle at least approximates 90°.

5. The apparatus of claim 1, wherein said deflecting means includes means for directing said force against the trailing sections of said pairs of sections so that the thus deflected trailing sections are moved away from the path of the respective leading sections.

6. The apparatus of claim 1, wherein said means for varying said force includes means for further varying said force as a function of at least one of a plurality of variable parameters including the flexibility of sheets, the temperature at least at one of said first path and said station, the moisture content of sheets, specific weight of the sheets, the dimensions of the sections of the sheets and the orientation of said paths relative to each other.

7. The apparatus of claim 6, wherein each of the sheets comprises a plurality of overlapping leaves and wherein said force is further varied as a function of the number of leaves in a sheet.

8. The apparatus of claim 6, wherein said force is further varied as a function of the thickness of the sheets.

9. The apparatus of claim 6, wherein said means for further varying said force includes at least one memory for storage of information pertaining to at least one of said variable parameters.

10. The apparatus of claim 9, wherein said information includes at least one of (a) characteristic curves and (b) functions relating at least one of said variable parameters to said force.

11. The apparatus of claim 9, wherein said characteristic curves relating at least one of said variable parameters to said force includes gradually and abruptly changing portions.

12. The apparatus of claim 1, wherein said variable force has at least one of an upper and a lower threshold value.

13. The apparatus of claim 1, wherein said variable force is zero when said one speed decreases to a predetermined minimum value.

14. The apparatus of claim 1, wherein said variable force remains constant at a predetermined maximum value when said one speed is above a preselected speed.

15. The apparatus of claim 1, wherein said means for deflecting comprises at least one suction generating device.

16. The apparatus of claim 15, wherein said suction generating device includes at least one of a blower and an ejector.

17. The apparatus of claim 15, wherein said at least one suction generating device comprises air stream generating means and means for directing the air stream against one side of the trailing section of each of said pairs of sections to thus establish a low-pressure zone entailing a deflection of the trailing section from the path of the oncoming leading section of the respective pair of sections.

18. The apparatus of claim 17, wherein said air stream generating means is a variable-output air stream generating means and said means for varying said force includes means for varying the output of said air stream generating means.

19. The apparatus of claim 7, wherein said means for varying said force includes means for further varying said force as a function of at least one of a plurality of variable parameters including the flexibility of sheets, the temperature at least at one of said first path and said station, the moisture content of sheets, specific weight of the sheets, the dimensions of the sections of the sheets and the orientation of said paths relative to each other;

wherein said air stream generating means is spaced apart from said directing means and said suction generating device further comprises a conduit connecting said air stream generating means with said directing means, said means for varying said force including an adjustable valve in said conduit and means for adjusting said valve as a function of said at least one of said plurality of parameters to thus alter the rate of air flow from said suction generating device to said directing means.

20. The apparatus of claim 19, wherein said valve adjusting means comprises a prime mover which is adjustable in dependency upon variations of said at least one of said pluraity of variable parameters.

21. The apparatus of claim 17, wherein said air stream generating means comprises an air compressor and said at least one suction generating device further comprises means for limiting the pressure of air supplied by said air compressor.

22. The apparatus of claim 1, further comprising a conveyor cooperating with at least one of said supplying means and said removing means to define the respective path.

23. The apparatus of claim 22, further comprising means for adjusting said conveyor relative to at least one of said supplying means and said removing means.

24. The apparatus of claim 23, wherein said adjusting means is located at said station.

25. The apparatus of claim 23, wherein said conveyor comprises at least one endless flexible element and said adjusting means comprises a roller engaging said flexible element and being movable relative to at least one of said supplying and said removing means.

26. The apparatus of claim 25, wherein said flexible element has a first side confronting said deflecting means, said supplying means and said removing means, and a second side contacted by said adjusting means.

27. The apparatus of claim 25, wherein said supplying means comprises a first pulley at said station and said removing means comprises a second pulley at said station, said directing means being disposed between said pulleys and confronting said roller.

28. A method of delivering successive flexible sheets of a file of non-overlapping sheets in a predetermined direction along a first path wherein a trailing section of each preceding sheet is located ahead of a leading section of the next-following sheet to a scalloping station where the trailing of preceding sheets are caused to overlap with the leading sections of the respective next-following sheets, comprising the steps of:

supplying successive sheets of the file in said direction along a first path to said station at a first speed;

removing successive sheets of the file from said station along a second path at a different second speed less than said first speed so that the leading sections of sheets arriving at said station overlap with the trailing sections of the respective preceding sheets;

deflecting at said station, with a variable force, at least one of each pair of sections including the trailing section of a preceding sheet and the leading section of the respective next-following sheet so that the sections of said pairs come to overlap with each other as a result of the difference between said first and second speeds; and varying said force as a function of one of said speeds, varying said force at least substantially proportionally with variations of said one speed, and respectively increasing and decreasing said force in response to an increase and decrease of said one speed.

29. The method of claim 28, further comprising further varying said force as a function of at least one of a plurality of variable parameters including the flexibility, moisture content and specific weight of sheets, the temperature at least at one of said first path and said station, the dimensions of the sections of the sheets and the orientation of said paths relative to each other.

30. Apparatus for delivering successive flexible sheets of a file of non-overlapping sheets in a predetermined direction along a first path, wherein a trailing section of each preceding sheet is located ahead of a leading section of the next-following sheet, to a converting station where the trailing sections of preceding sheets are caused to overlap with the leading sections of the respective next-following sheets, comprising:

first conveyor means for supplying successive sheets of the file in said direction along said first path to said station at a first speed;

second conveyor means for removing successive sheets of the file from said station along a second path at a different second speed such that the leading sections of sheets arriving at said station overlap with the trailing sections of the respective preceding sheets;

means for deflecting at said station at least one of each pair of sections including the trailing section of a preceding sheet and the leading section of the respective next-following sheet so that the sections of said pairs can overlap with each other as a result of the difference between said speeds;

third conveyor means including a portion disposed at said station and cooperating with at least one of said first and second conveyor means to guide the sheets relative to said deflecting means; and means for adjusting said portion of said third conveyor means relative to said at least one conveyor means.

31. The apparatus of claim 30, wherein said adjusting means comprises at least one rotary member.

32. The apparatus of claim 30, wherein said portion of said third conveyor means comprises at least one endless flexible element overlying said station.

33. The apparatus of claim 32, wherein said adjusting means comprises at least one roller engaging said at least one endless flexible element and being movable relative to said station in a plurality of directions.

* * * * *